US008623245B2

(12) United States Patent
Ren

(10) Patent No.: US 8,623,245 B2
(45) Date of Patent: Jan. 7, 2014

(54) PROCESS OF MAKING COLORED HIGH STRENGTH POLYETHYLENE FIBER

(75) Inventor: Yi Ren, Laiwu (CN)

(73) Assignee: Shandong ICD High Performance Fibres Co., Ltd., Laiwu (CN)

( * ) Notice: Subject to any disclaimer, the term of this patent is extended or adjusted under 35 U.S.C. 154(b) by 1090 days.

(21) Appl. No.: 12/600,241

(22) PCT Filed: Jul. 14, 2008

(86) PCT No.: PCT/CN2008/001308

§ 371 (c)(1),
(2), (4) Date: Nov. 13, 2009

(87) PCT Pub. No.: WO2009/105925

PCT Pub. Date: Sep. 3, 2009

(65) Prior Publication Data

US 2010/0233479 A1 Sep. 16, 2010

(30) Foreign Application Priority Data

Feb. 26, 2008 (CN) ..... 2008 1 0014184

(51) Int. Cl.

| | |
|---|---|
| ***D01D 5/06*** | (2006.01) |
| ***D01D 5/088*** | (2006.01) |
| ***D01D 5/16*** | (2006.01) |
| ***D01D 10/06*** | (2006.01) |
| ***D01F 1/04*** | (2006.01) |
| ***D01F 6/04*** | (2006.01) |

(52) U.S. Cl.

USPC ..... 264/78; 264/178 F; 264/184; 264/203; 264/210.6; 264/210.7; 264/210.8; 264/211; 264/211.12; 264/211.14; 264/211.15; 264/211.16; 264/211.17; 264/211.22; 264/211.23; 264/233; 264/234

(58) Field of Classification Search

USPC ..... 264/37.2, 78, 178 F, 184, 203, 210.6, 264/210.7, 210.8, 211, 211.12, 211.14, 264/211.15, 211.16, 211.17, 211.22, 264/211.23, 233, 234

See application file for complete search history.

(56) References Cited

U.S. PATENT DOCUMENTS

| | | | | | |
|---|---|---|---|---|---|
| 3,583,925 | A | * | 6/1971 | Zweidler | 8/137 |
| 3,968,307 | A | * | 7/1976 | Matsui et al. | 428/373 |
| 4,545,950 | A | * | 10/1985 | Motooka et al. | 264/210.6 |
| 4,663,101 | A | * | 5/1987 | Kavesh et al. | 264/178 F |
| 5,256,358 | A | * | 10/1993 | Shiraki et al. | 264/210.7 |
| 5,613,987 | A | | 3/1997 | Kuroki et al. | |
| 5,693,708 | A | * | 12/1997 | Iwanami et al. | 524/585 |
| 7,147,807 | B2 | * | 12/2006 | Kavesh | 264/37.13 |

FOREIGN PATENT DOCUMENTS

| | | | | |
|---|---|---|---|---|
| CN | 1425811 | A | * | 6/2003 |
| CN | 101148783 | A | * | 3/2008 |
| JP | 7-268784 | A | | 10/1995 |
| JP | 7-238416 | | | 3/1997 |
| JP | 11-21721 | A | | 1/1999 |
| JP | 2005213674 | A | | 8/2005 |

* cited by examiner

*Primary Examiner* — Leo B Tentoni
(74) *Attorney, Agent, or Firm* — Kenyon & Kenyon LLP

(57) ABSTRACT

A colored high strength polyethylene fiber, preparation method and use thereof are provided, which are in the high molecular material field. The surface of said high strength polyethylene fiber is chromatic, grey or black. The strength of said high strength polyethylene fiber is 15-50 g/d, its modulus is 400-2000 g/d. The product of the present invention is colored, so it can be well applied to civil and military field. The preparation method of present invention has some advantages that technological process is simple, production efficiency is high, cost of production is low, performance of made fiber is excellent, and use-cost is reduced, compared with the prior art.

12 Claims, No Drawings

PROCESS OF MAKING COLORED HIGH STRENGTH POLYETHYLENE FIBER

BACKGROUND

1. Field of the Invention

The present invention relates to a kind of high strength polyethylene fiber, especially a kind of colored high strength polyethylene fiber, and their preparation method and application.

2. Description of Related Art

High strength polyethylene (HS-PE) fibers are well known synthetic fibers with high strength and modulus, and are produced from ultrahigh molecular weight polyethylene (UHMWPE) with a molecular weight higher than 1,000,000. Right now, HS-PE fibers, Aramid fibers and carbon fibers are considered as three high performance fibers in the world. Due to its high strength, high modulus and low density, the UHMWPE fiber plays an important role not only in modern warfare, defense equipment and aerospace field, but also in civil fields.

Conventionally, HS-PE fibers are mostly produced from UHMWPE by the so-called gel-spinning and ultra-heat drawing processes. However, during these two processes, the UHMWPE, as long, flexible macromolecule chains, has a tendency to be entangled together. In order to avoid this problem, the UHMWPE has to be dissolved in a solvent, which could enlarge the distance of macromolecule chains by diluting the concentration of the UHMWPE. HS-PE fibers with extended chains could be obtained by ultra-heat drawing and molecule tropism of UHMWPE gel precursor fibers with moderate macromolecule entanglement points. The method mainly has five steps: (1) getting a spinning solution by solving UHMWPE in a solvent; (2) getting solvent-embedded wet precursor fibers with moderate molecular chain entanglements by extruding the solution from a spinneret hole and quenching curing in air or water; (3) removing the solvent by certain extraction solvent; (4) drying the precursor fibers in an oven; and (5) getting HS-PE fibers with extended chain crystal by ultra-heat drawing of the precursor fibers.

Japanese Patent No. 7-238416 discloses a method for preparing HS-PE fibers by evaporating a solvent actively during a dry-spinning process, and its specific process includes dissolving UHMWPE (5~50%) in a volatile solvent (95~50%) first and then transferring precursor fibers obtained by thermal extrusion through a spinning cylinder. During this process, more than 40% of the solvent is evaporated by continually purging stable hot air flow into the cylinder. Residual solvent can be removed during a heat-drawing process. In this patent, the spinning adhesion problem could be solved by forming semi-dry precursor fibers through actively removing partial solvent in the spinning process. However, because the solvent evaporation happens in both spinning and heat-drawing processes, fireproofing and explosion-proofing and solvent recovery must be carried out separately during the spinning and drawing processes. Obviously, these operations increase the investment in equipment and make the solvent recovery more difficult, which are unfavorable for large-scale industrial production.

High-strength is the main goal of the prior art processing technology, resulting in HS-PE fibers which have tensile strength mostly larger than 30 cN/dtex and are in white color. Due to the complexity of the production process and high price, HS-PE fibers are usually used in military field. However, polyethylene fibers with a tensile strength ranging from 15 to 30 cN/dtex could already meet the requirements of applications in civil fields. Therefore, it is a waste of fiber performance and resources to use polyethylene fibers with a tensile strength higher than 30 cN/dtex in civil fields. And the increase of cost limits the application of polyethylene fibers with a tensile strength higher than 30 cN/dtex in civil fields. In addition, in certain application fields, such as rope nets, there is usually requirements for colors. However, it is difficult to color these fibers by general methods because there are no other functional groups in UHMWPE's macromolecular chains except for the C—H bond, with which is hard to combine dye molecules. No work has been reported on methods for preparing colored HS-PE fibers.

SUMMARY OF THE INVENTION

One objective of the present invention is to provide a method for preparing colored HS-PE fibers, which not only make civil products more attractive and easier to distinguish, but also provide better hidden effects in the military field.

According to the present invention, a kind of colored HS-PE fiber is provided, which is characterized in that:

- the surface of the HS-PE fiber is in multicolor, grey or black; and
- its tensile strength ranges from 15 to 50 cN/dtex, the tensile elastic modulus is from 400 to 1000 cN/dtex, the filament number ranges from 4 to 5 dtex and the elongation at break is smaller than 3.5%.

When the tensile strength of the colored HS-PE fiber of the present invention ranges from 15 to 30 cN/dtex, it can be generally applied in, but not limited to, the following civil fields: (1) marine engineering, such as ropes, cables, and sailing and fishing gears; (2) sports equipment, such as safety helmets, skiing boards, sailing boards, fishing rods, rackets, super-light parts of bicycles, gliding boards and aircrafts; (3) biological materials, for example, fiber reinforced composites in denture materials, medical grafts, plastic surgeries and other clinical usages due to the advantages such as good biocompatibility and durability, high stability and allergies-absence, and medical gloves and other medical facilities as well; (4) industrial materials, such as pressure vessels, conveyers, filter materials, and car bumpers with the fiber and its composite materials. In addition, the fiber and its composite materials can be used in walls, partition structures and other building materials. The toughness of concrete can be improved when the fiber is used as the reinforced cement composite materials.

When the tensile strength of the colored HS-PE fiber of the present invention ranges from 30 to 50 cN/dtex, it can be generally applied in, but not limited to, the following fields: (1) defense equipment, such as protective clothing, helmets, bullet-proof materials, helicopters, protective boards of tanks and armored ships, protective shells of radars, missile shield, bullet-proof vests, anti-thorn clothing, and shields; (2) aerospace applications, such as tip structure of spacecrafts and aircrafts, and hydroplane.

The usage of the fiber of the present invention is basically similar to that of fibers obtained by the prior art method when it is applied in the above-mentioned fields.

Sometimes it is necessary to make HS-PE fibers in different colors to facilitate collocation, distinction, aesthetics and marketing in civil fields, and to realize hidden function by means of colorization in the military field. However, the HS-PE fiber obtained by the existing technology is white, which greatly restricts its applications in the above-mentioned fields. And this problem can be solved by the present invention.

Colored HS-PE fibers are produced by a gel spinning process including swelling and dissolving UHMWPE in a solvent to prepare precursor fibers. The method is characterized in the addition of an inorganic pigment with particle size smaller than 1 μm, the weight ratio of which to the UHMWPE is 1.0 to 3.0% based on the weight of UHMWPE.

The method for preparing the colored HS-PE fiber is described in detail as follows:

(1) Preparing a Spinning Solution

A UHMWPE with a molecular weight higher than 3,000,000 is chosen as the basic fiber component, and white mineral oil is employed as a solvent. These two materials are mixed first, the weight ratio of which may range from 1:7 to 1:9, and then, inorganic pigments are added into the solution of UHMWPE and mineral oil. When the mixture of raw materials become uniform by heating and mixing, it is transferred into a twin-screw extruder for heating, causing the UHMWPE to swell and dissolve at a temperature between 100 and 300° C. to get the spinning solution.

The white mineral oil described in the present invention is commercially available.

(2) Preparing a UHMWPE Gel Precursor Fiber

A liquid filament is obtained by extruding the spinning solution out from a plate and the pore diameter of the plate may range from 0.5 to 1.6 mm. Subsequently, the liquid filament is transferred to a spinning tank with a temperature between 15 and 25° C. through an air-gap. The multiple of air-gap drawing is from 4 to 8 times. Then, the UHMWPE gel precursor fiber is obtained by cooling the liquid filament.

(3) Extracting the UHMWPE Gel Precursor Fiber

The UHMWPE gel precursor fiber is extracted by rolling the gel fiber into a bed by a wire and the extractant is xylene. After extraction, the white mineral oil and the extractant are recovered in a separation process for recycle.

Taking cost factors into account, mixed xylene is employed in the present invention.

(4) Drying the Spinning Fiber

The extracted fiber is placed in an oven and dried by hot air with a temperature between 45 and 55° C. The extractant contained in the fiber is recovered by the adsorption of activated carbon fiber in a recovery device.

(5) Backing Drafting and Winding to get a Colored HS-PE Fiber

To get the colored HS-PE fiber, the dried fiber is backing drafted 1 to 3 times after being pulled out from the oven. The draft multiple is between 1 and 6 times.

The colored HS-PE fiber of the present invention can also be obtained by other preparation methods like the melt spinning method, in which a spinning solution is obtained by melting a UHMWPE. One characteristic of this method is the addition of an inorganic pigment with particle size smaller than 1 μm, the weight ratio of which to the UHMWPE is 1.0 to 3.0% based on the weight of the UHMWPE.

The details of the preparation process of the colored HS-PE by the melt spinning method are as follows:

1) Mixing Raw Materials

A UHMWPE with molecular weight in the range of 1,000,000 to 3,000,000 is adopted and inorganic pigments are added. The inorganic pigments are about 1.0 to 3.0% of the weight of the UHMWPE. A uniform solution is obtained by mixing.

2) Melting

A polyethylene melt is obtained by melting the mixture solution of step 1) in a twin-screw extruder with a temperature between 150 and 300° C. During the process, a melt diluent is added.

3) Preparing a New-Born Fiber and Drawing

The obtained polyethylene melt is extruded out from a spinning plate of a spinning box, and the spray speed is about 3 to 5 m/min. Subsequently, the new-born fiber is obtained through cooling molding of extruded filatures by a blast apparatus. The cooling temperature is maintained between 20 and 35° C. and the wind speed is about 5 to 8 m/s. The new-born fiber is drawn in a godet roller and the draft multiple is 2 to 6 times.

4) Drawing in Two Oil Baths

The new born fiber is transferred into two oil baths filled with glycol by a godet roller and stretched evenly. The temperature of the oil bath may range from 100 to 130° C. and the total draft multiple is 3 to 12 times.

5) Oil Removal in a Water Bath

The drafted fiber is washed in a water bath containing heterogeneous alcohol surfactants with a temperature between 80 and 95° C.

6) Drying the Fiber to Obtain an HS-PE Fiber

After washing, the fiber is dried to remove the water and is winded onto a tube to get the HS-PE fiber with tensile strength ranging from 10 to 50 cN/dtex.

The inorganic pigments employed in the present invention are commercially available and they must endure high temperature up to 300° C. For example, the inorganic pigments contain, but not limited to, following materials: ultramarine, phthalocyanine blue, chromium oxide green, lead chrome green, iron oxide, carbon black, bismuth vanadate, bismuth molybdate yellow, calcium exchanged silica pigments, chrome cobalt green, ferrotitanium brown, copper-chromium black, alkali resistance iron blue, middle chrome yellow light fast, easily dispersible iron blue, zinc barium yellow, zinc barium green, zinc barium red, manganese antimony titanate brown, and mica pearlescent pigment titanium dioxide coated.

The benefits of the fiber of this invention lie in:

1) Since the HS-PE fiber of the present invention has different colors like grey, black and so on, it is easy to realize color collocation to make the products more attractive in civil fields. In certain fields, different types of products can be distinguished by different colors, which could facilitate their usage. In the military field, fibers in different colors can be used according to the change of terrain and climate, which could improve the hidden effect.

2) Low molecular-weight PE can be employed in the melt spinning method.

3) In comparison with the prior art, the present invention has advantages of better quality, higher product purity, simpler production process, higher production efficiency and lower production costs.

EMBODIMENTS

Example 1

Preparing a Blue HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:9. A phthalocyanine blue inorganic pigment, which is 1.0% of the weight of the UHMWPE, is added to the solution of UHMWPE and white mineral. Then the mixture of raw materials becomes uniform by heating and mixing. Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 1.0 mm. Subsequently, the liquid filament is transferred into a spinning tank at 20° C. The multiple of air-gap drawing is 8 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air at 50° C. The extractant contained in the fiber is recovered by the adsorption of activated carbon fiber in a recovery device.

5) Backing Drafting and Winding to get the Blue HS-PE Fiber

To get the blue HS-PE fiber, the dry fiber is backing drafted 3 times after pulling out from the oven and the three draft multiples are 2 times, 2 times and 1.5 times, respectively. After drafting, the fiber is wound onto a tube to get the blue HS-PE fiber. Seven draft rolls and a hot oven are included in drawing process.

It is found in tests that the blue HS-PE fiber obtained by this process has a tensile strength of 50 cN/dtex and tensile elastic modulus of 2000 cN/dtex. The passing rate is about 98%.

Example 2

Preparing a Green HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:7. A chromium oxide green inorganic pigment, which is 3.0% of the weight of the UHMWPE, is added to the solution of UHMWPE and white mineral. Then the mixture of raw materials becomes uniform by heating and mixing. Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 1.6 mm. Subsequently, the liquid filament is transferred into a spinning tank at 24° C. The multiple of air-gap drawing is 7 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air at 54° C. The extractant contained in the fiber is recovered by the adsorption of activated carbon fiber in a recovery device.

5) Backing Drafting and Winding to get the Green HS-PE Fiber

To get the green HS-PE fiber, the dry fiber is backing drafted 2 times after pulling out from the oven and the two draft multiples are 3 times and 1.5 times, respectively. After drafting, the fiber is wound onto a tube to get an HS-PE fiber in green. Seven draft rolls and a hot oven are included in the drawing process.

It is found in tests that the green HS-PE fiber obtained in this process has a tensile strength of 15 cN/dtex and a tensile elastic modulus of 410 cN/dtex. The passing rate is about 99%.

Example 3

Preparing a Red HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:8. An iron oxide inorganic pigment, which is 2.0% of the weight of the UHMWPE, is added into the solution of UHMWPE and white mineral. Then the mixture of raw materials becomes uniform by heating and mixing. Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 0.5 mm. Subsequently, the liquid filament is transferred into a spinning tank with a temperature between 18 and 20° C. The multiple of air-gap drawing is 5 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air with a temperature between 50 and 52° C. The extractant contained in the fiber is recovered by the adsorption of activated carbon fiber in a recovery device.

5) Backing Drafting and Winding to get the Red HS-PE Fiber

To get the red HS-PE fiber, the dry fiber is backing drafted 3 times after pulling out from the oven and the three draft multiples are 2 times, 2 times and 1.5 times, respectively. After drafting, the fiber is wound onto a tube to get an HS-PE fiber in red. Seven draft rolls and a hot oven are included in the drawing process.

It is found in tests that the red HS-PE fiber obtained in this process has a tensile strength of 40 cN/dtex and a tensile elastic modulus of 1350 cN/dtex. The passing rate is about 99%.

Example 4

Preparing a Black HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:9. A carbon black inorganic pigment, which is 2% of the weight of UHMWPE, is added to the solution of UHMWPE and white mineral. Then the mixture of raw materials becomes uniform by heating and mixing.

Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 1.0 mm. Subsequently, the liquid filament is transferred into a spinning tank with a temperature between 18 and 20° C. The multiple of air-gap drawing is 8 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air at 50° C. The extractant contained in the fiber is recovered by adsorption of activated carbon fiber in a recovery device.

5) Backing Drafting and Winding to get the Black HS-PE Fiber

To get the black HS-PE fiber, the dry fiber is backing drafted 3 times after pulling out from the oven and the three draft multiples are 3 times, 3 times and 1.5 times, respectively. After drafting, the fiber is wound onto a tube to get an HS-PE fiber in black. Seven draft rolls and a hot oven are included in the drawing process.

It is found in tests that the black HS-PE fiber obtained in this process has a tensile strength of 30 cN/dtex and a tensile elastic modulus of 970 cN/dtex. The passing rate is about 98%.

Example 5

Preparing a Blue HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:8. Ultramarine and phthalocyanine blue inorganic pigments, which are 2.0% of the weight of UHMWPE, are added to the solution of UHMWPE and white mineral. Then the mixture of raw materials becomes uniform by heating and mixing. Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 0.5 mm. Subsequently, the liquid filament is transferred into a spinning tank with a temperature between 20 and 24° C. The multiple of air-gap drawing is 6 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air with a temperature between 46 and 50° C. The extractant contained in the fiber is recovered by adsorption of activated carbon fiber in a recovery device.

5) Backing Drafting and Winding to get the Blue HS-PE Fiber

To get the blue HS-PE fiber, the dry fiber is backing drafted 3 times after pulling out from the oven and the three draft multiples are 2.5 times, 2.5 times and 1.5 times, respectively. After drafting, the fiber is wound onto a tube to get the blue HS-PE fiber. Seven draft rolls and a hot oven are included in the drawing process.

It is found in tests that the blue HS-PE fiber obtained in this process has a tensile strength of 38 cN/dtex and a tensile elastic modulus of 1250 cN/dtex. The passing rate is about 99%.

Example 6

Preparing a Green HS-PE Fiber

1) Preparing a Spinning Solution

The spinning solution is prepared by adopting a UHMWPE with molecular weight higher than 3,000,000 and employing white mineral oil as a solvent. The weight ratio of UHMWPE and white mineral oil is 1:9. Chromium oxide green and lead chrome green inorganic pigments, which are 2.0% of the weight of UHMWPE, are added into the solution. The mixture of raw materials becomes uniform by heating and mixing. Subsequently, this mixture is transferred into a twin-screw extruder and heated. After swelling and dissolving the UHMWPE with a temperature between 100 and 300° C., the spinning solution is obtained.

2) Preparing a UHMWPE Gel Precursor Fiber

A liquid filament is obtained by extruding the spinning solution out from a plate and the pore diameter of the plate is 1.0 mm. Subsequently, the liquid filament is transferred into a spinning tank with a temperature between 20 and 22° C. The multiple of air-gap drawing is 6 times. Then, the UHMWPE gel precursor fiber is obtained by cooling the liquid filament.

3) Extraction of the UHMWPE Gel Precursor Fiber

Extraction of the UHMWPE gel precursor fiber is carried out by rolling the gel fiber into a bed by a wire and the extractant is xylene. After extraction, the white mineral oil and the extractant are recovered in a separation process for recycle.

4) Drying the Fiber Spinning

The extracted fiber is placed in an oven and dried by hot air with a temperature between 48 and 50° C. The extractant contained in the fiber is recovered by adsorption of activated carbon fiber in a recovery device.

5) Backing Drafting and Winding to get the Green HS-PE Giber

To get the green HS-PE fiber, the dry fiber is backing drafted 2 times after pulling out from the oven and the draft multiples are 3 times and 1.5 times, respectively. After drafting, the fiber is wound onto a tube to get the green HS-PE fiber. Seven draft rolls and a hot oven are included in drawing process.

It is found in tests that the green HS-PE fiber obtained in this process has a tensile strength of 35 cN/dtex and a tensile elastic modulus of 1200 cN/dtex. The passing rate is about 97%.

Example 7

Preparing a Colored HS-PE Fiber by the Melt Spinning Method

1) Mixing Raw Materials

A UHMWPE with molecular weight in the range of 1,000,000 to 3,000,000 is adopted and inorganic pigments, which are about 1.0 to 3.0% of the weight of the UHMWPE based on customer requirements, are added. A uniform solution is obtained by mixing.

2) Melting

A polyethylene melt with proper viscosity for drawing is obtained by melting the mixture solution of step 1) in a twin-screw extruder with a temperature between 150 and 300° C. During the process, a melt diluent which can be easily obtained by currently available technology is added.

3) Preparing a New-Born Fiber and Drawing

The obtained polyethylene melt is extruded from a spinning plate of a spinning box and the spray speed is about 3 to 5 m/min. Subsequently, the new-born fiber is obtained through cooling molding of extruded filatures by a blast apparatus. The cooling temperature may range from 20 to 35° C. and the wind speed is about 5 to 8 m/s. The new-born fiber is drawn in a godet roller and the draft multiple is about 2 to 6 times.

4) Drawing in Two Oil Baths

The new born fiber is transferred into two oil baths filled with glycol by godet roller and stretched evenly. The temperature of the oil bath is maintained between 100 and 130° C. The total draft multiple is 3 to 12 times.

5) Oil Removal in a Water Bath

The drafted fiber is washed in a water bath containing heterogeneous alcohol surfactants with a temperature between 80 and 95° C.

6) Drying the Fiber to Obtain an HS-PE Fiber

After washing, the fiber is dried to remove the water and is wound onto a tube to get the HS-PE fiber with tensile strength ranging from 15 to 50 cN/dtex.

To pursuit color diversification of the products, composite inorganic pigments can also be used in the present invention.

The above-mentioned embodiments are only used to illustrate the present invention, not intended to limit the scope thereof. Many modifications of the embodiments can be made without departing from the spirit of the present invention.

What is claimed is:

1. A method for preparing a colored high strength polyethylene fiber, wherein the surface of the fiber is covered with multicolor, grey or black, a tensile strength of the fiber is from 15 to 50 cN/dtex and a tensile elastic modulus of the fiber is from 400 to 2000 cN/dtex, with a gel spinning process which comprises a procedure of precursor fiber preparation by swelling an ultrahigh molecular weight polyethylene in a solvent, the method comprising: adding an inorganic pigment with particle size smaller than 1 μm, wherein a weight ratio of the inorganic pigment to the ultrahigh molecular weight polyethylene ranges from 1.0 to 3.0%;

wherein the inorganic pigment is selected from the group consisting of: lead chrome green, bismuth vanadate, bismuth molybdate yellow, calcium exchanged silica pigments, chrome cobalt green, ferrotitanium brown, copper-chromium black, alkali resistance iron blue, easily dispersible iron blue, zinc barium yellow, zinc barium green, zinc barium red, manganese antimony titanate brown, and mica pearlescent pigment titanium dioxide coated.

2. The method according to claim 1, further comprising:

(1) using a UHMWPE having a molecular weight more than 3,000,000 as a basic fiber component and white mineral oil as a solvent, mixing these two materials at a weight ratio ranging from 1:7 to 1:9, adding the inorganic pigment to a solution of UHMWPE and mineral oil, heating and mixing a mixture of these raw materials to make it uniform, and transferring the mixture into a twin-screw extruder to heat the UHMWPE at a temperature between 100 and 300° C., causing the UHMWPE to swell and dissolve to get a spinning solution;

(2) obtaining a liquid filament by extruding the spinning solution out from a plate whose pore diameter is about 0.5 to 1.6 mm, transferring the liquid filament to a spinning tank with a temperature between 15 and 25° C. through an air-gap, and cooling the liquid filament to obtain a UHMWPE gel precursor fiber, wherein the multiple of air-gap drawing is from 4 to 8 times;

(3) extracting the UHMWPE gel precursor fiber by rolling the gel fiber by a wire using xylene as an extractant, and recovering the white mineral oil and the extractant in a separation process for recycling;

(4) placing the extracted fiber in an oven to dry it by hot air with a temperature between 45 and 55° C., and recovering the extractant contained in the fiber adsorption of activated carbon fiber in a recovery device; and (5) backing drafting the dry fiber from 1 to 3 times after pulling out it from the oven, wherein the draft multiple is between 1 to 6 times.

3. A method for preparing a colored high strength polyethylene fiber, wherein the surface of the fiber is covered with multicolor, grey or black, a tensile strength of the fiber is from 15 to 50 cN/dtex and a tensile elastic modulus of the fiber is from 400 to 2000 cN/dtex, with a melt spinning method which obtains a melt solution by melting a UHMWPE, the method comprising: adding an inorganic pigment with particle size smaller than 1 μm, wherein a mass ratio of the inorganic pigment to the UHMWPE is 1.0 to 3.0%;

wherein the inorganic pigment is selected from the group consisting of: lead chrome green, bismuth vanadate, bismuth molybdate yellow, calcium exchanged silica pigments, chrome cobalt green, ferrotitanium brown, copper-chromium black, alkali resistance iron blue, easily dispersible iron blue, zinc barium yellow, zinc barium green, zinc barium red, manganese antimony titanate brown, and mica pearlescent pigment titanium dioxide coated.

4. The method of claim 3 further comprising:

(1) mixing raw materials including the UHMWPE with weight average molecular weight ranging from 1,000,000 to 3,000,000 and the inorganic pigment to obtain a uniform mixture solution;

(2) melting the mixture solution in a twin-screw extruder at a temperature ranging from 150 to 300° C. to obtain a polyethylene melt, and adding a melt diluent;

(3) extruding the polyethylene melt from a spinning plate of a spinning box with a spray speed of about 3 to 5 m/min, obtaining a new-born fiber through cooling molding of extruded filatures by a blast apparatus with a cooling temperature maintained between 20 and 35° C. and a wind speed about 5 to 8 m/s, and drawing the new-born fiber in a godet roller with a draft multiple of 2 to 6 times;

(4) transferring the new born fiber into two oil baths filled with glycol by godet roller and stretching it evenly, wherein a temperature of the oil bath ranges from 100 to 130° C. and a total draft multiple is 3 to 12 times;

(5) washing the drafted fiber in a water bath containing heterogeneous alcohol surfactants with a temperature between 80 and 95° C. to remove oil; and (6) drying the fiber to remove water and winding the fiber onto a tube to get an HS-PE fiber.

5. The method of claim 1, further comprising: using a UHMWPE having a molecular weight more than 3,000,000 as a basic fiber component and white mineral oil as a solvent, and heating the UHMWPE to get a spinning solution.

6. The method of claim 5, further comprising: obtaining a liquid filament by extruding the spinning solution, and cooling the liquid filament to obtain a UHMWPE gel precursor fiber.

7. The method of claim 6, further comprising: extracting the UHMWPE gel precursor fiber.

8. The method of claim 7, further comprising: drying the extracted fiber.

9. The method of claim 8, further comprising: backing drafting the dry fiber.

10. The method of claim 3, wherein the UHMWPE has a weight average molecular weight ranging from 1,000,000 to 3,000,000.

11. The method of claim 10, further comprising: melting a mixture solution of the UHMWPE and inorganic pigment to obtain a polyethylene melt; extruding the polyethylene melt; and obtaining a new-born fiber through cooling molding of extruded filatures.

12. The method of claim 11, further comprising: transferring the new born fiber into an oil bath.

* * * * *

UNITED STATES PATENT AND TRADEMARK OFFICE

CERTIFICATE OF CORRECTION

PATENT NO. : 8,623,245 B2
APPLICATION NO. : 12/600241
DATED : January 7, 2014
INVENTOR(S) : Yi Ren It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1091 days.

Signed and Sealed this
Twenty-second Day of September, 2015

Michelle K. Lee

Michelle K. Lee
*Director of the United States Patent and Trademark Office*